US006959857B2

(12) United States Patent
Bates

(10) Patent No.: US 6,959,857 B2
(45) Date of Patent: Nov. 1, 2005

(54) DISPENSING FEATURE WITH BUILT-IN AD PANEL

(75) Inventor: Aaron Bates, Marietta, GA (US)

(73) Assignee: Meadwestvaco Packaging Systems, LLC, Stamford, CT (US)

( * ) Notice: Subject to any disclaimer, the term of this patent is extended or adjusted under 35 U.S.C. 154(b) by 39 days.

(21) Appl. No.: 10/444,877

(22) Filed: May 23, 2003

(65) Prior Publication Data

US 2004/0232214 A1 Nov. 25, 2004

(51) Int. Cl.[7] ..... B65D 5/72

(52) U.S. Cl. ..... 229/122.1; 229/122.1; 229/221; 206/427

(58) Field of Search ..... 229/219, 122.1, 229/225, 221, 224; 206/427, 125

(56) References Cited

U.S. PATENT DOCUMENTS 3,048,324 A * 8/1962 Anderson ..... 229/207
3,306,514 A * 2/1967 Mackendrick ..... 229/219
3,411,697 A * 11/1968 Hightower et al. ..... 229/240
3,424,301 A 1/1969 Forrer et al.
5,326,024 A * 7/1994 Fogle ..... 229/214
5,678,755 A * 10/1997 Block ..... 229/215
6,176,419 B1 * 1/2001 Holley, Jr. ..... 229/122.1
6,484,903 B2 11/2002 Spivey et al.
2002/0070139 A1 6/2002 Bates
2003/0089763 A1 * 5/2003 Boriani et al. ..... 229/122.1

* cited by examiner

*Primary Examiner*—Tri M. Mai
(74) *Attorney, Agent, or Firm*—Tsugihiko Suzuki

(57) ABSTRACT

A carton for dispensing articles having a dispensing feature with a built-in ad panel. A plurality of panels are connected together to define an end of the carton. A displaceable portion at the end of the carton may be detached from the carton to define an opening for dispensing the articles from within the carton. The opening partially defines a positionable portion which is moveable between a first position and a second position. The positionable portion may be used as an ad panel to allow greater promotional flexibility.

15 Claims, 3 Drawing Sheets

DISPENSING FEATURE WITH BUILT-IN AD PANEL

TECHNICAL FIELD

The present invention relates generally to paperboard cartons for use in packaging articles and, more particularly, relates to a dispensing carton with a built-in ad panel.

BACKGROUND OF THE INVENTION

Cartons are useful for allowing consumers to purchase and transport a desired quantity of articles such as soft drinks. For the convenience of the consumer, some cartons have dispensers which allow the articles to be removed one at a time while continuing to encase the remaining articles. However, more than one article is often dispensed at a time from the carton which unfortunately leads to many of the articles being dispensed onto the consumer's floor. This is because articles within the carton are not sufficiently restrained by the carton.

Another problem with known dispensing cartons is that after the endmost article is removed from the carton through the dispenser, another article is not pushed forward up to the dispenser so that it can also be removed by the consumer at a subsequent time. This often is because there is insufficient back pressure on the articles remaining within the carton.

Also, it is often desirable to have a large surface area on the exterior of the carton for labeling and advertising. However, in order to utilize the dispensing features of known dispensing cartons, portions of the carton may be permanently removed or positioned such that the available surface area is reduced.

Therefore, there is a need for an improved carton having a dispenser that is adapted to adequately restrain the articles within the carton while also facilitating access to the endmost article to be dispensed from the carton. The improved carton must also appeal to the customer while maximizing the available surface area for advertising.

SUMMARY OF THE INVENTION

The present invention provides a carton with a dispenser having a built-in ad panel which allows greater promotional flexibility. The built-in ad panel is moveable into a position for restraining a top row of articles and for maintaining the back pressure on a lower row of articles to push the lower row of articles toward the dispenser.

Generally described, the carton of the present invention includes a dispensing feature with a built-in ad panel. A plurality of panels are connected together. A displaceable portion at an end of the carton may be detached from the carton to define an opening for dispensing the articles from within the carton. The opening partially defines a positionable portion which is moveable between first and second positions. The positionable portion may be used as an ad panel. While in the second position, the positionable portion restrains the upper row of articles from falling through the opening in the carton.

According to one aspect of the present invention, the carton is formed from a single blank having a continuous weakened line extending between end flaps of first and second side panels and across a center top panel of the blank. End portions of the continuous line in the side panels are tear lines to permit the displaceable portion to be at least partially detached from the carton after the carton has been erected. An intermediate portion of the continuous line in the center top panel permits the positionable portion to move between the first and second positions after the displaceable portion has been at least partially detached from the carton.

According to another aspect of the present invention, the opening formed from detaching the displaceable portion defines an upper edge of a stopper portion in the end of the carton. The stopper portion restrains a lower row of articles and the positionable portion, when in the second position, restrains an upper row of articles.

The foregoing has broadly outlined some of the more pertinent aspects and features of the present invention. These should be construed to be merely illustrative of some of the more prominent features and applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

Figure 1:
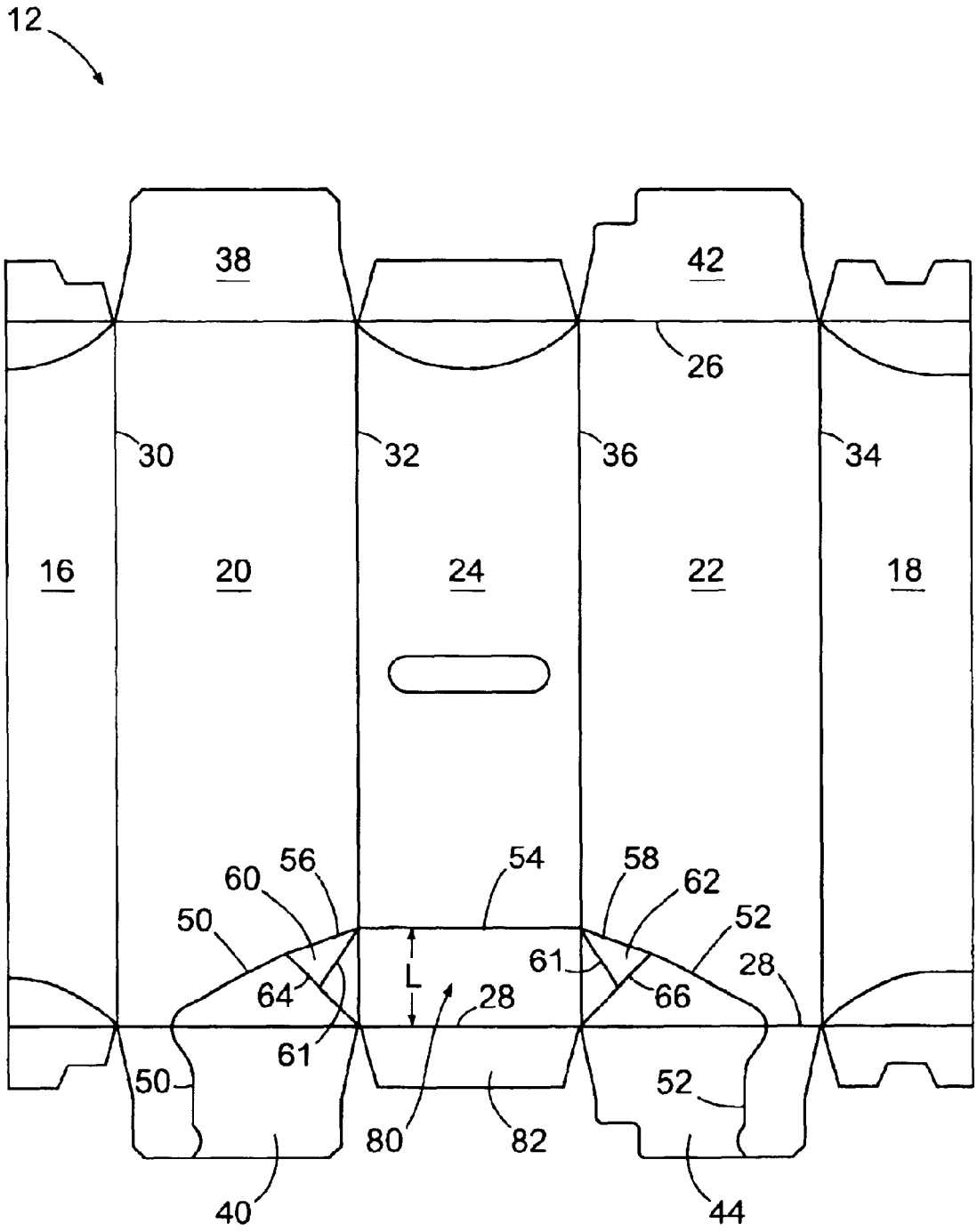
FIG. 1 illustrates a plan view of one embodiment of a blank for forming the carton of the present invention having a dispenser with an ad panel.

Referring now to the drawings in which like numerals indicate like elements throughout the several views, the drawings illustrate an exemplary embodiment of a carton 10 of the present invention. In one embodiment, the carton 10 is a carton for dispensing articles such as beverage cans.

Generally described, the carton 10 is formed from a foldable sheet material such as paperboard blank 12 as shown in FIG. 1. The blank 12 includes five primary panels for forming the carton 10. The panels of the blank 12 are a first bottom panel 16, a second bottom panel 18, a first side panel 20, a second side panel 22, and a center top panel 24. As shown in FIG. 1, the panels of the blank 12 are hingedly connected in series to one another. The first bottom panel 16 is hingedly connected to the first side panel 20 by fold line 30. The first side panel 20 is then hingedly connected to the center top panel 24 by fold line 32. The second bottom panel 18 is hingedly connected to the second side panel 22 by fold line 34. The second side panel 22 is then hingedly connected to the center top panel 24 by fold line 36.

Each of the panels 16, 18, 20, 22 and 24 include opposing end flaps defined by transverse fold lines 26 and 28. Fold lines 26 and 28 each extend the full width of the blank 12. First side panel 20 includes opposing end flaps 38 and 40 and second side panel 22 includes opposing end flaps 42 and 44. In order to erect the carton 10, bottom panel 16 and bottom panel 18 are glued or are otherwise secured together to form the bottom of the carton 10. After the articles are loaded into the carton 10, the end flaps are folded and secured together to form the opposed closed ends of the carton 10. End flap 40 is connected to end flap 44 and end flap 38 is connected to end flap 42.

Figure 2:
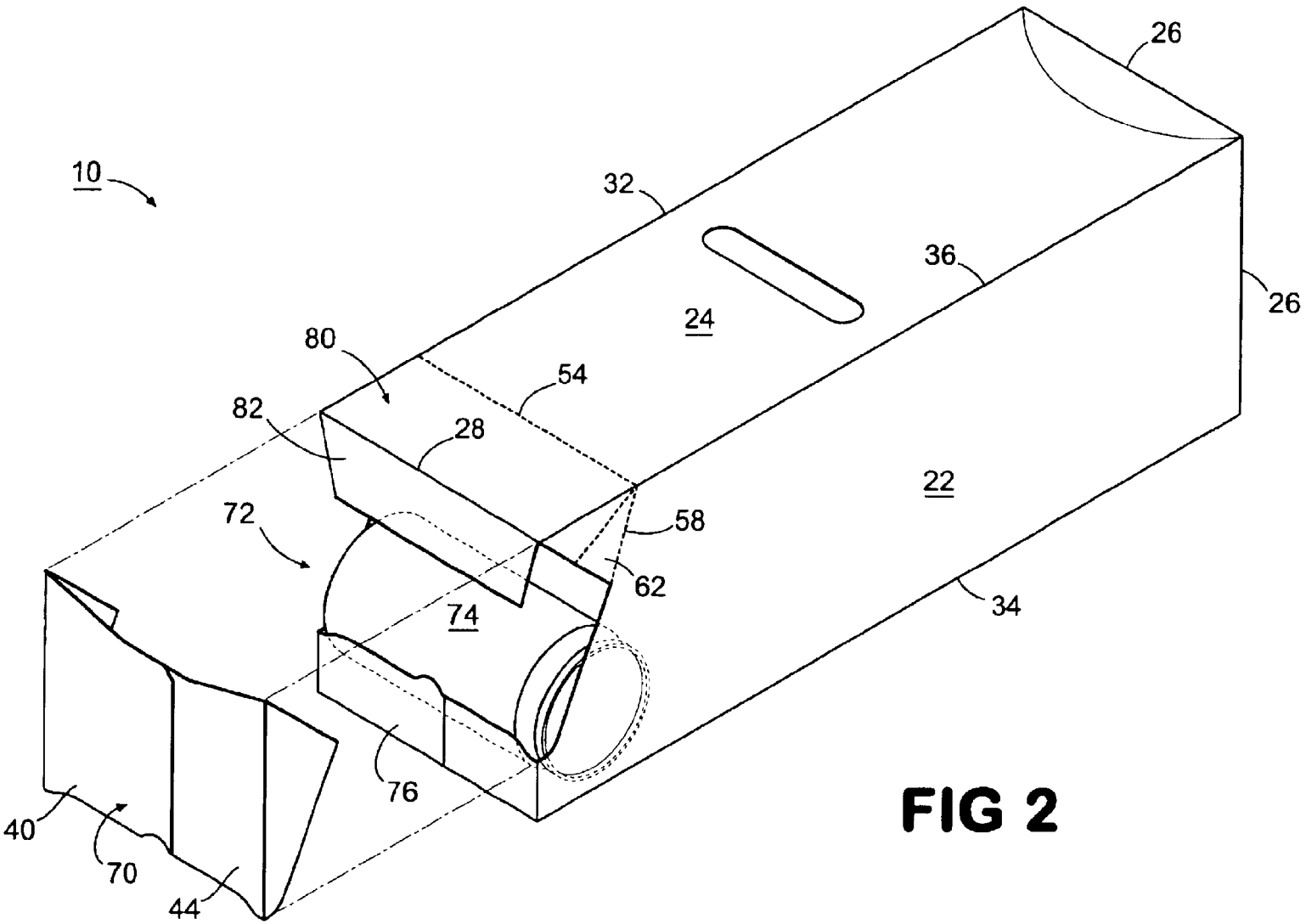
FIG. 2 is a perspective view of one embodiment of the carton of the present invention formed from the blank of FIG. 1 with a portion of the carton removed for dispensing articles.
Figure 3:
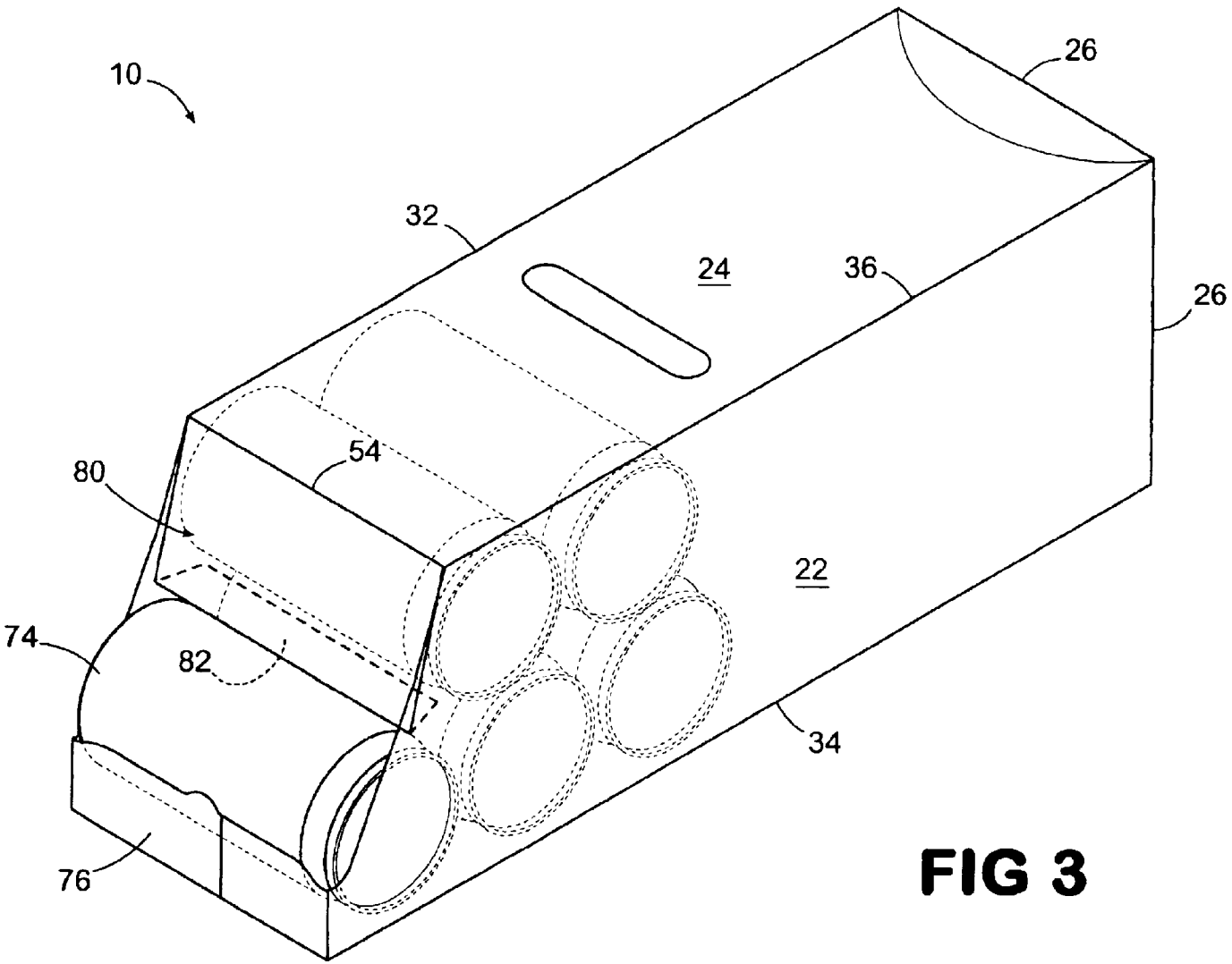
FIG. 3 is a perspective view of one embodiment of the carton of the present invention illustrating the positioning of the ad panel for restraining a top row of articles.

The carton illustrated in the drawings is adapted to hold a group of similarly dimensioned, cylindrical articles (such as cans or bottles), in a plurality of vertically arranged rows (two rows in FIGS. 2 and 3). The articles in each row are disposed on their sides in a side-by-side parallel fashion. The side panels 20 and 22 are disposed alongside the ends of the articles of the group while each end flap of the carton is disposed adjacent to the side walls of the respective endmost articles.

As best shown in FIG. 1, the blank 12 includes a continuous weakened line extending from end flap 40 of first side panel 20, across center top panel 24, and onto end flap 44 of second side panel 22. An end portion 50 of the weakened line extends from the distal end of end flap 40 and onto a portion of the side panel 20. A second end portion 52 extends from the distal end of end flap 44 and onto a portion of sided panel 22. The end portions 50 and 52 are preferably tear lines which would permit a portion of the carton 10 to be at least partially removed from the carton 10 to form an opening for dispensing articles as described in greater detail below.

An intermediate fold line portion 54 of the continuous line extends across the center top panel 24. Intermediate fold line portion 54 extends between and intersects with fold lines 32 and 36. From the intersection of intermediate line portion 54 with each of the fold lines 32 and 36, extends a fold line 56 and a fold line 58 which connect with end portions 50 and 52, respectively. Therefore, end portion 50 connects with fold line 56 which then connects with intermediate fold line 54 at fold line 32. End portion 52 connects with fold line 58 which then connects with intermediate fold line 54 at fold line 36.

The combination of fold lines 56 and 58, with portions of fold lines 32 and 34, partially defines gussets 60 and 62. The gussets 60 and 62 are further defined by tear lines 64 and 66. Tear lines 64 and 66 extend from the intersection of the fold lines 32 and 36 with fold line 28 to the intersection of end portions 50 and 52 with fold lines 56 and 58, respectively. Therefore, gusset 60 is defined in side panel 20 by fold line 56, tear line 64, and a portion of fold line 32. Gusset 62 is defined in side panel 22 by fold line 58, tear line 66, and a portion of fold line 36. Each gusset is foldable along medial fold line 61 which will be described later in more details.

The combination of the tear line 64 with the tear line 50 allows a portion of the end flap 40 to be removed from the erected carton 10. Also, the combination of the tear line 66 with the tear line 52 allows a portion of the end flap 44 to be removed from the erected carton 10. The portions removed from the end flaps 40 and 44 together define a displaceable portion 70 of the carton 10. As best shown in FIG. 2, the removal of displaceable portion 70 does not alter the center top panel 24.

However, the partial or complete removal of displaceable portion 70 from the carton 10 defines an opening 72 for dispensing articles from the carton 10. For example, as shown in FIG. 2, the endmost can 74 of the lower row of cans may be removed through opening 72. The can 74 is prevented from rolling out of the carton 10 through the opening 72 by stopper portion 76. The stopper portion 76 is formed by the remaining portions of end flaps 40 and 44 after removal of displaceable portion 70. The upper edge of the stopper portion 76 is defined by the opening 72 after removal of displaceable portion 70.

Still referring to FIG. 2, the center top panel 24 with intermediate line portion 54 includes a positionable portion 80 which is moveable due to the presence of the opening 72. Positionable portion 80 may be utilized as a built-in ad panel for advertising indicia to allow greater promotional flexibility for the carton 10. In FIG. 2, the positionable portion 80 is in a first position for dispensing articles. While the positionable portion 80 is in the first position, the length of the carton 10 along the top center panel 24 remains substantially equivalent to the length of the carton 10 along the bottom panels 20 and 22.

Gussets 60 and 62 support the positionable portion 80 while in the first position. The gussets 60 and 62, with the positionable portion 80 in the first position, may also obstruct from view a portion of the articles within the carton 10. As shown in FIG. 3, however, the gussets 60 and 62 may be folded inwardly along the respective medial fold lines 61 to allow the positionable portion 80 to be folded into a second position which alters the length along the top of the carton 10. The gussets 60 and 62 themselves become obscured from view by the positionable portion 80 and side panels 20 and 22 when the positionable portion 80 is in the second position. Also, the opening 72 is configured differently for dispensing articles when the positionable portion 80 is moved between the first and second positions. The opening 72 while the positionable portion 80 is in the first position is substantially larger then when the positionable portion 80 is in the second position.

While in the second position, the positionable portion 80 restrains a portion, but not all, of the articles within the carton 10. In FIG. 3, the positionable portion 80 in the second position restrains an upper row of cans within the carton 10 while still permitting cans to be dispensed through the opening 72. Because the upper row of cans is restrained by the positionable portion 80 in the second position, sufficient back pressure is maintained on the lower row of cans to push the endmost can forward toward the opening 72.

An end flap 82 of the positionable portion 80 may be positioned in between the upper and lower rows of cans to further secure the positionable portion 80 in the second position. For this purpose, it is preferred that the vertical length of the positionable portion 80 (or the distance "L" between the fold lines 28 and 54 in FIG. 1) is generally equal to $(N-1)\times D$ where "N" is the number of rows of cylindrical articles contained in the carton and "D" is the diameter of each cylindrical article. In the illustrated arrangement, the vertical length "L" is generally equal to the can diameter since the number of rows of cans is two. Otherwise, the vertical length of the positionable portion 80 may be less than $(N-1)\times D$ according the present invention where "N" and "D" are the same as defined above.

The present invention has been illustrated in relation to a particular embodiment which is intended in all respects to be illustrative rather than restrictive. Those skilled in the art will recognize that the present invention is capable of many modifications and variations without departing from the scope of the invention. Accordingly, the scope of the present invention is described by the claims appended hereto and supported by the foregoing.

What is claimed is:

1. A carton for dispensing articles, comprising:

a plurality of panels defining an end of said carton;

a displaceable portion detachably connected to said carton end to be at least partially detached from said carton to define an opening for exposing an endmost article for removal, said opening defining an upper edge of a stopper portion of said carton end for restraining articles within said carton; and a positionable portion partially defined by said opening, said positionable portion adapted to be moveable between first and second positions, said positionable portion in said second position for restraining articles, and wherein said opening is configured differently for dispensing articles when said positionable portion is moved between said first and second positions, said carton further comprising a continuous line extending from end flaps of first and second opposing side panels of said carton and across a center top panel of said carton, wherein end portions of said line are weakened lines to permit said displaceable portion to be at least partially detached from said carton, and wherein an intermediate portion of said line is a fold line permitting said positionable portion to be moved between said first and second positions when said displaceable portion is at least partially detached.

2. The carton of claim 1 wherein said stopper portion restrains a lower row of articles and said positionable portion in said second position restrains an upper row of articles.

3. The carton of claim 2 wherein said positionable portion includes a distal flap portion, said distal flap portion being adapted to be positioned between said upper and lower rows of articles when said displaceable portion is in said second position.

4. The carton of claim 1 wherein said positionable portion is formed from a portion of said top panel.

5. The carton of claim 1 wherein said positionable portion cooperates with a pair of gussets defined by said opposing side panels of said carton to permit said positionable portion to move between said first and second positions.

6. The carton of claim 5 wherein said gussets are obscured from view when said positionable portion is in said second position.

7. The carton of claim 1 wherein said displaceable portion is defined by said end flaps of said opposing side panels of said carton.

8. The carton of claim 1 wherein said stopper portion is defined by portions of said end flaps of said opposing side panels of said carton.

9. The carton of claim 1 wherein said top panel of said carton remains in its entirety after said displaceable portion is removed from said carton.

10. The carton of claim 1 wherein lengths of said top panel and a bottom panel of said carton remain substantially equivalent after said displaceable portion is detached from said carton.

11. A carton formed from a single blank, said blank comprising:

first and second side panels hingedly connected to first and second bottom panels respectively;

a center top panel hingedly connected between said first and second side panels;

a displaceable portion defined by end flaps of said side panels to be at least partially detached from said carton to define an opening for dispensing articles when said blank is formed into said carton; and a positionable portion defined by said center top panel, said positionable portion configured to be moveable between a first position and a second position when said displaceable portion is removed from said carton, said blank further comprising a continuous line extending from end flaps of said first and second side panels and across said center top panel, wherein end portions of said line are weakened lines to permit said displaceable portion to be at least partially detached when said carton is formed from said blank, and wherein an intermediate portion of said line is a fold line permitting said positionable portion to be moved between said first and second positions when said displaceable portion is at least partially detached.

12. The carton of claim 11 further comprising a pair of gussets defined by said side panels of said blank, said gussets configured to permit said positionable portion to move between said first and second positions when said blank is formed into said carton.

13. The carton of claim 11 wherein said center top panel of said blank is free from lines for defining said displaceable portion in said blank.

14. The carton of claim 11 wherein said displaceable portion is defined by said end flaps of said first and second side panels.

15. The carton of claim 11 wherein said positionable portion is formed from a portion of said top panel.

* * * * *